US006012618A

United States Patent [19]

Matsuo

[11] Patent Number: 6,012,618

[45] Date of Patent: Jan. 11, 2000

[54] TANK FOR AUTONOMOUS RUNNING AND WORKING VEHICLE

[75] Inventor: Takashi Matsuo, Amagasaki, Japan

[73] Assignee: Minolta Co., Ltd., Osaka, Japan

[21] Appl. No.: 08/867,670

[22] Filed: Jun. 2, 1997

[30] Foreign Application Priority Data

Jun. 3, 1996 [JP] Japan ..... 8-140321

[51] Int. Cl.[7] ..... B65D 25/40; B65D 88/54

[52] U.S. Cl. ..... 222/566; 222/325

[58] Field of Search ..... 141/351, 352, 141/353, 354, 356, 364, 18, 21; 222/566, 80, 325

[56] References Cited

U.S. PATENT DOCUMENTS

| | | | |
|---|---|---|---|
| 1,735,784 | 11/1929 | Olson | 222/212 |
| 1,752,085 | 3/1930 | Hinkle | 222/212 |
| 2,906,300 | 9/1959 | Becher | 141/352 |
| 4,393,894 | 7/1983 | Mol | 141/353 |
| 5,307,956 | 5/1994 | Richter | 141/351 |
| 5,309,592 | 5/1994 | Hiratuska . | |
| 5,524,680 | 6/1996 | de Laforcade | 141/351 |

FOREIGN PATENT DOCUMENTS

| | | | |
|---|---|---|---|
| 720269 | 10/1965 | Canada | 222/80 |
| 328161 | 2/1904 | France | 141/351 |
| 62-104751 | 7/1987 | Japan . | |
| 807145 | 1/1959 | United Kingdom | 141/18 |

*Primary Examiner*—Randall E. Chin
*Attorney, Agent, or Firm*—McDermott, Will & Emery

[57] ABSTRACT

A tank includes a tank portion with an opening formed at a flat surface which serves as a bottom portion when in use, and a liquid dispensing member having a cylindrical shape and protruding outward from the tank portion at a right angle to the flat surface from the opening with its tip end portion cut diagonally with respect to the central axis of the cylinder. As a result, even a cleaning liquid having high surface tension such as water can be dropped out through the liquid dispensing opening.

7 Claims, 24 Drawing Sheets

TANK FOR AUTONOMOUS RUNNING AND WORKING VEHICLE

BACKGROUND OF THE INVENTION

1. Field of the Invention

The present invention relates to a tank for containing liquid.

2. Description of the Related Art

An autonomous running and working robot having a tank containing cleaning liquid provided on its body, which runs while applying liquid to the floor surface has been proposed. Liquid dispensing opening of the tank is provided at a bottom surface of the tank, and a valve having similar structure for a tank used for an oil stove has been known. By placing the tank at a tank receiving portion of the autonomous running and working robot, the liquid contained in the tank flows out of the tank through the liquid dispensing opening. The emitted liquid can be applied to the floor surface by a working unit designed therefor.

However, liquid such as water used for cleaning by the autonomous running and working robot has high surface tension. Therefore, the liquid does not flow out from the liquid dispensing opening unless the liquid dispensing opening is adapted to have considerably large opening area. However, if the opening area of the liquid dispensing opening is increased, the valve itself becomes larger, degrading sealing property.

SUMMARY OF THE INVENTION

Therefore, an object of the present invention is to provide a tank which can drop out cleaning liquid such as water having high surface tension through a liquid dispensing opening.

The tank for dispensing a small amount of liquid contained therein includes a liquid reservoir portion containing liquid, having a bottom plate portion with an opening which serves as a bottom portion during use, a liquid dispensing cylinder portion provided protruding out from the liquid reservoir portion from the opening in a vertical direction with respect to the bottom plate, with a tip end portion cut diagonally with respect to a central axis, an opening/closing valve for opening/closing the opening, and an urging spring urging the valve to a closed position.

According to the tank of the present invention, an opening formed at a flat surface which serves as a bottom portion in use is protruded in a cylindrical shape to the outside of the tank portion, and the tip end portion of the cylinder is cut diagonally with respect to the central axis of the cylinder. Therefore, even a liquid having high surface tension drops out from the tip end portion of the opening, as the balance between gravity effect and surface tension is lost at the tip end portion having the diagonally cut shape.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
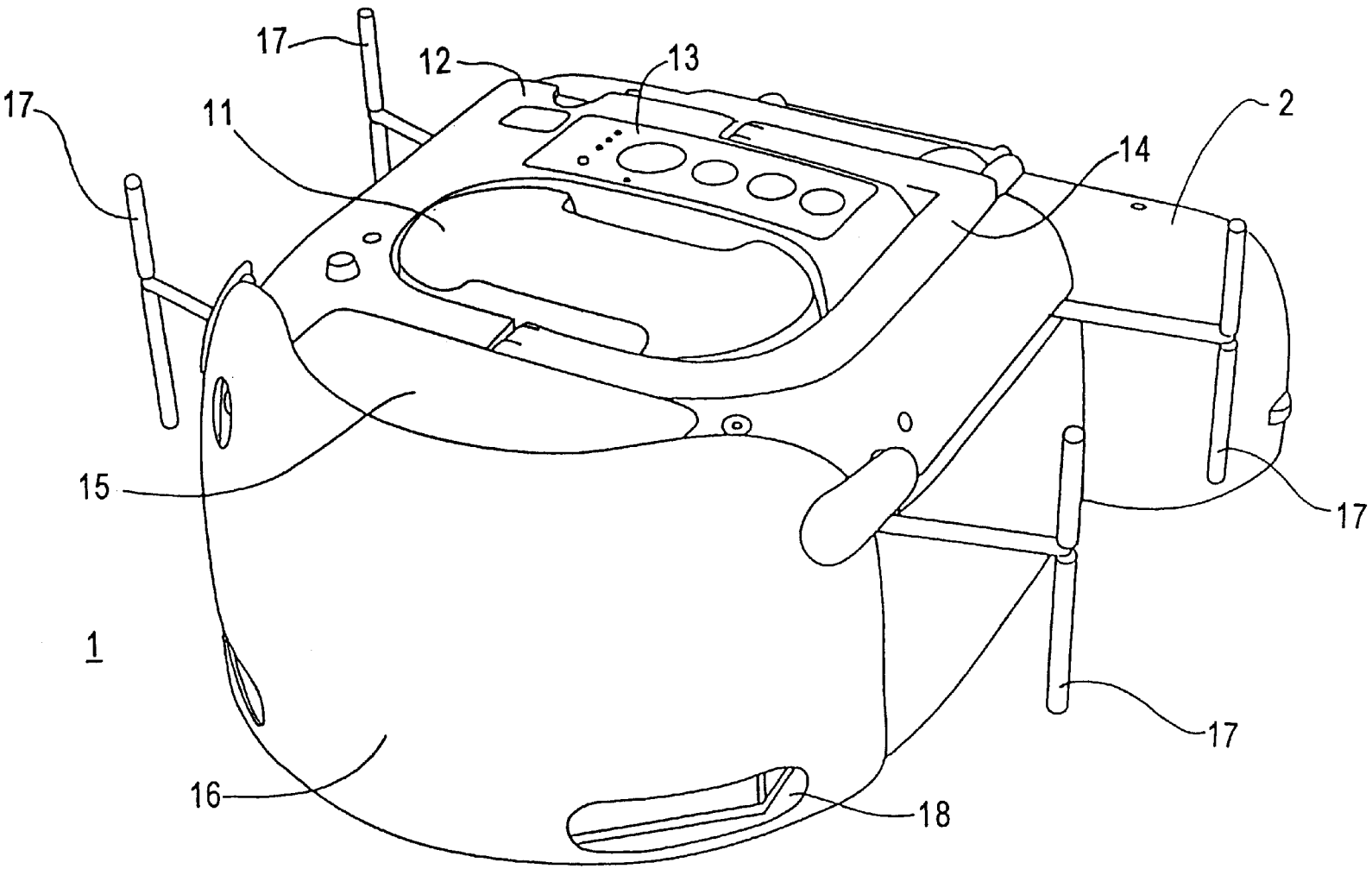
FIG. 1 is a perspective view showing an overall structure of an autonomous running and working robot.
Figure 2:
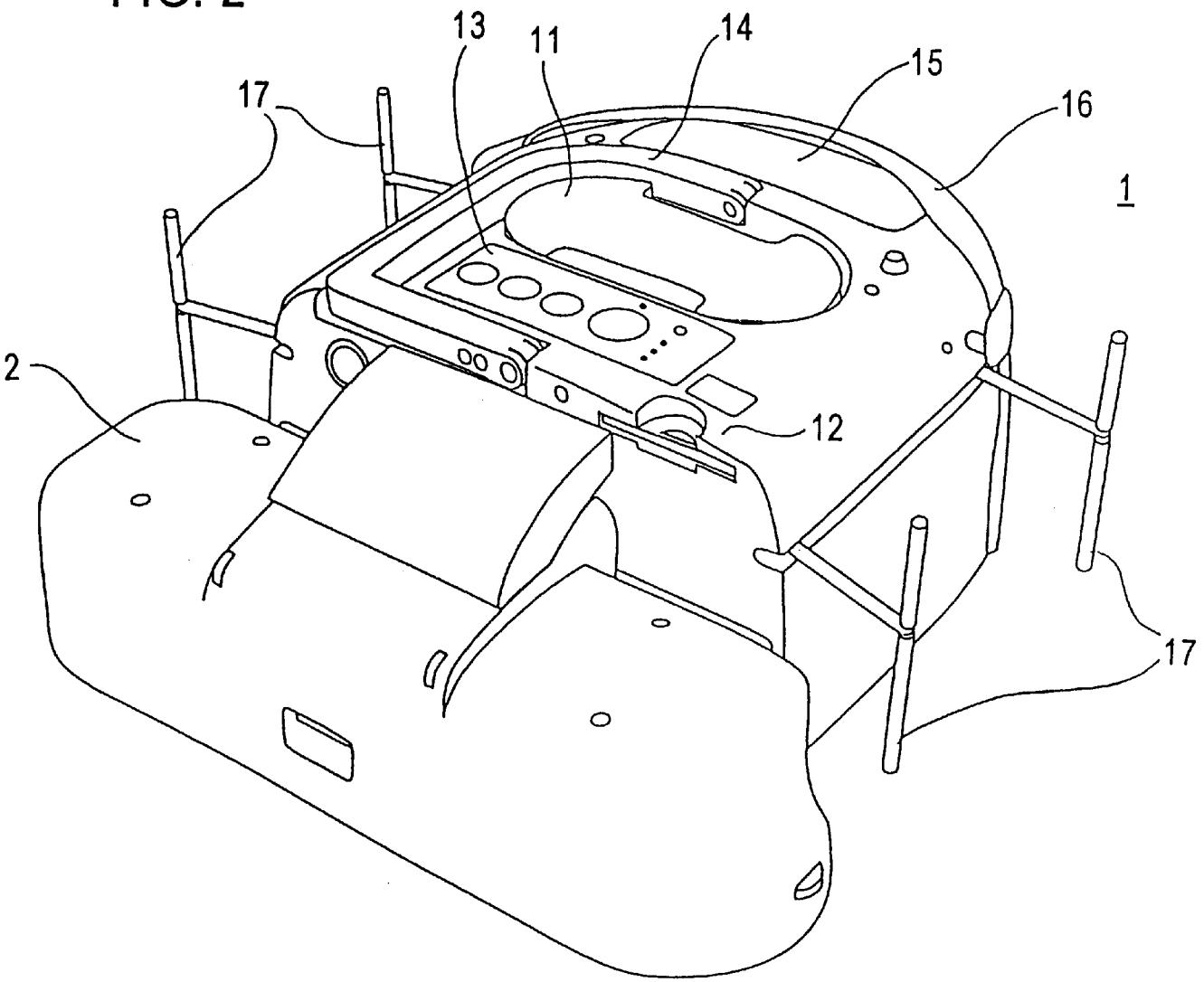
FIG. 2 is a rear perspective view showing an overall structure of the autonomous running and working robot.

The autonomous running and working robot in accordance with the embodiments of the present invention will be described with reference to the figures.

The autonomous running and working robot in accordance with the embodiment of the present invention may be used for various applications. As an example, an autonomous running and working robot for cleaning and waxing will be described in detail.

Referring to FIGS. 1, 2, 3 and 4, the autonomous running and working robot includes a body 1 and a working unit 2. Body 1 includes a tank 11, an IC card mounting portion 12, an operation panel 13, a handle 14, a battery 15, a bumper sensor 16, a touch sensor 17 and a distance measuring window 18.

Figure 4:
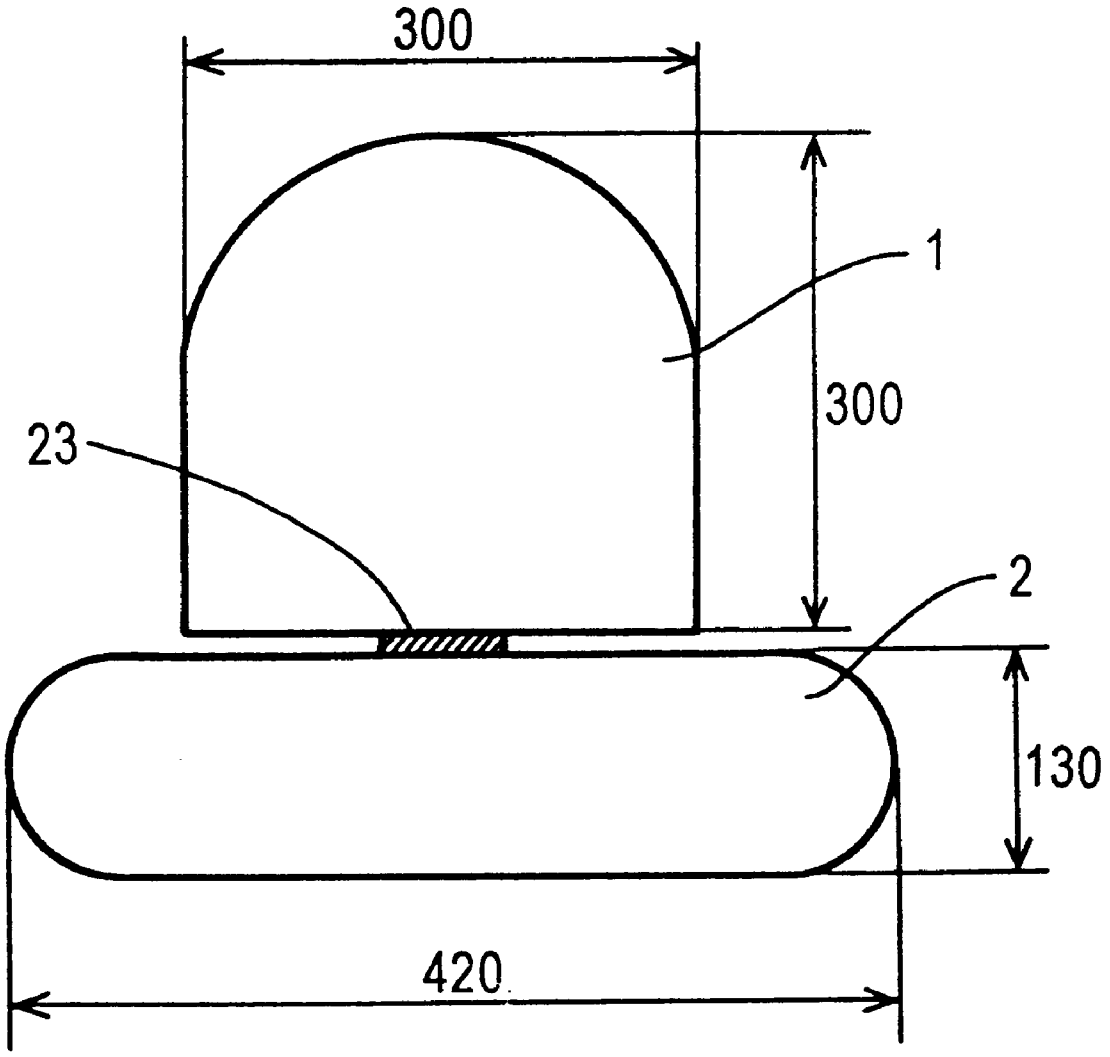
FIG. 4 is a plan view showing structures of the body, working unit and the coupling unit of the autonomous running and working robot.

Liquid such as water, detergent or wax is contained in tank 11. The liquid contained in tank 11 is fed to working unit 2 by a pump (not shown) through a hose (not shown). Working unit 2 is supported movable in the left and right directions of body 1 by a sliding mechanism (not shown). Working unit 2 is driven in the left and right directions by means of the sliding mechanism (not shown) by a motor. On a side surface of body 1, touch sensor 17 for detecting an obstacle is provided. As shown in FIG. 4, the size of body 1 is about 300 mm×300 mm, while the size of working unit 2 is about 420 mm×130 mm. The weight of working unit 2 is about 1500 g.

Figure 5:
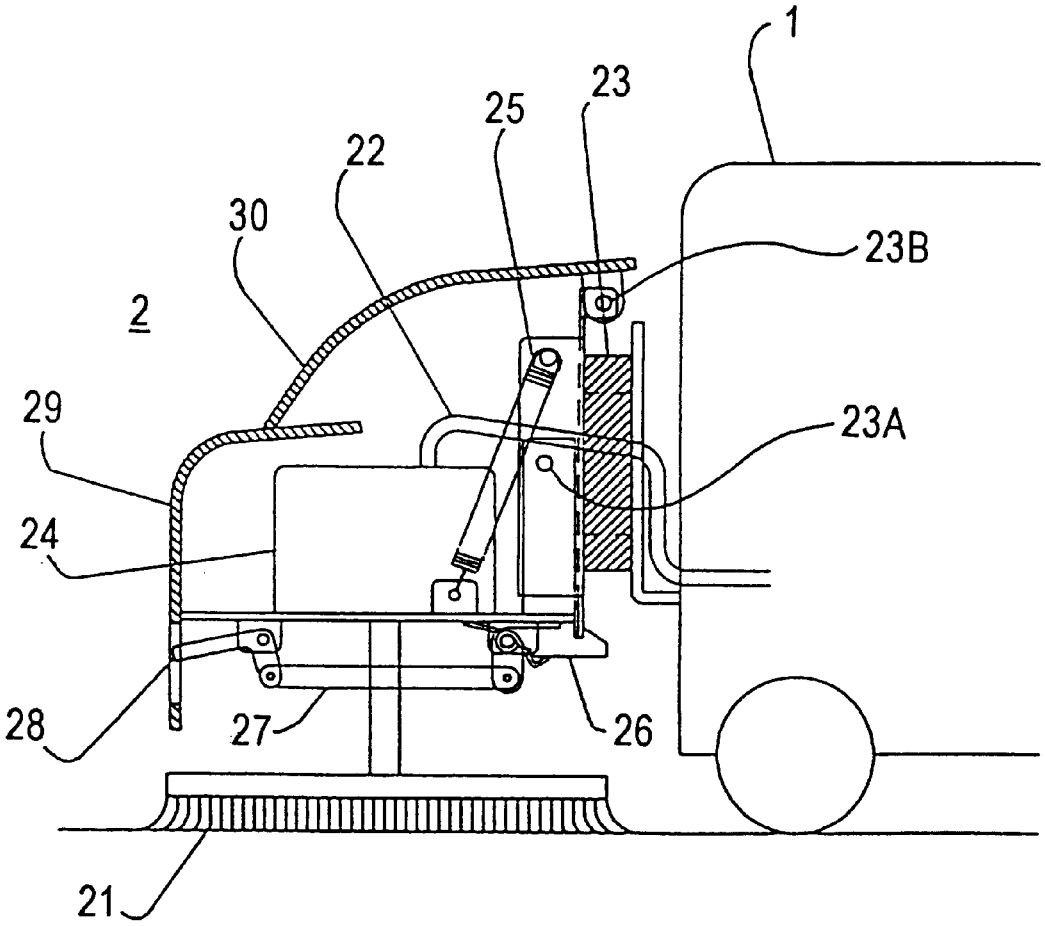
FIG. 5 is a cross section showing a structure of the working unit of the autonomous running and working robot.

The working unit 2 shown in FIGS. 1 to 4 will be described in greater detail. FIG. 5 is a cross section showing the structure of working unit 2 shown in FIGS. 1 to 4.

Referring to FIG. 5, working unit 2 includes a brush 21, a nozzle (not shown), a hose 22, a coupling member 23, a brush driving motor 24, a spring 25, a lock member 26, a coupling arm 27, a lock canceling lever 28, a first cover 29 and a second cover 30.

Figure 3:
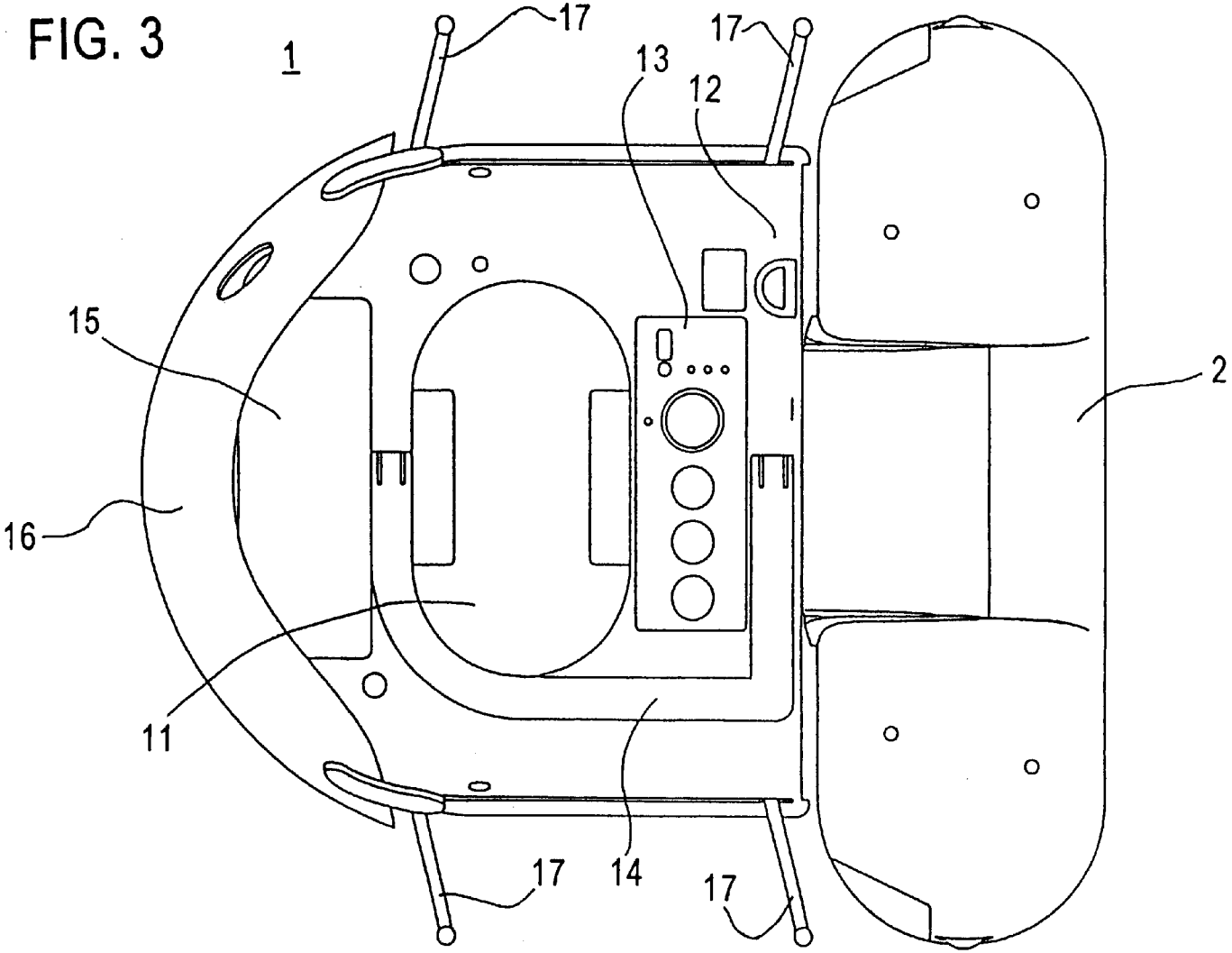
FIG. 3 is a plan view showing the overall structure of the autonomous running and working robot.

Four brushes 21, which will be described later, are rotatably attached to the lower portion of working unit 2. Near each brush 21, a nozzle for jetting liquid pushed out by the pump through four distributed hoses is provided. The four brushes 21 are coupled to a rotary axis of brush driving motor 24 by a coupling mechanism, not shown, and rotary driven by brush driving motor 24. In order to widen the working area which is to be cleaned and waxed by four brushes 21, the working width by the four brushes 21 is made wider than the body 1 of the working unit, as shown in FIG. 3.

Working unit 2 is rotatably supported at a fulcrum 23A of coupling member 23 and urged upward by spring 25. Working unit 2 is locked at coupling member 23 by lock member 26 at a lowermost rotatable position. Lock member 26 is releasably coupled to lock canceling lever 28 by means of coupling arm 27. The first cover 29 protects inside of working unit 2 and is fixed on working unit 2 in such a shape that has a notch to avoid abutting against coupling member 23 and body 1 at the time of rotation. The second cover 30 is rotatably fixed on a fulcrum 23B of coupling member 23 at a position abutting the first cover 29. The first cover 29 also serves as a touch sensor.

Figure 6:
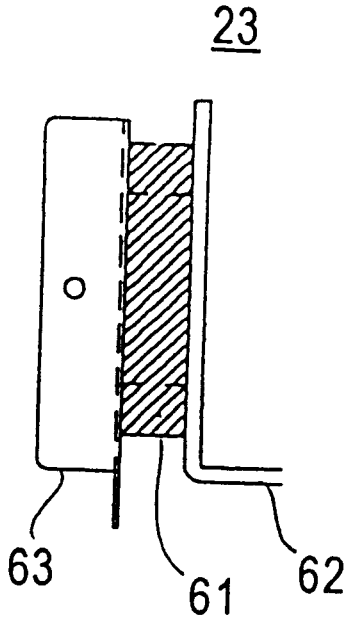
FIGS. 6 and 7 show first example of the structure of the coupling member of the autonomous running and working robot.
Figure 7:
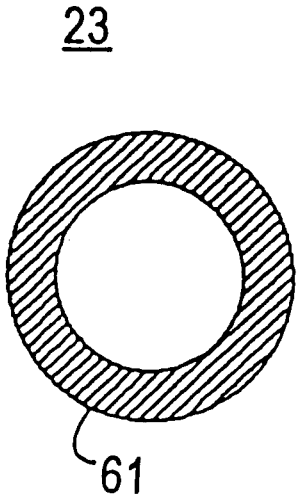

Referring to FIGS. 6 and 7, coupling member 23 shown in FIG. 5 will be described in greater detail. FIGS. 6 and 7 show a first example of the structure of the coupling member.

Referring to FIGS. 6 and 7, coupling member 23 includes a buffer member 61 and support members 62 and 63. Buffer member 61 has a ring shape. Support members 62 and 63 have holes of approximately the same size as the hole of buffer member 61 at the corresponding positions, so that coupling member 23 come to have a through hole at this portion. The ring of buffer member 61 has an outer diameter of about 52 mm, inner diameter of about 40 mm and thickness of about 5.4 mm.

Since buffer member 61 has a ring-shape, it can absorb uniformly the shock and external force in every direction. The through hole at the center may be used for arranging pipes such as hose 22 or wires, as will be described later.

Figure 8:
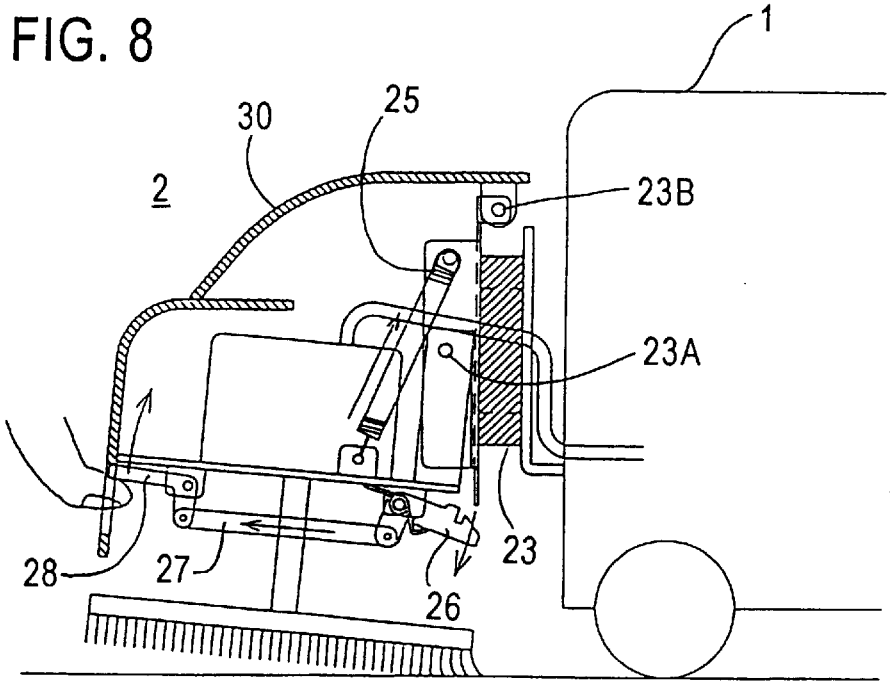
FIGS. 8 and 9 are cross sections showing operations of the working unit and the coupling member of the autonomous running and working robot.
Figure 9:
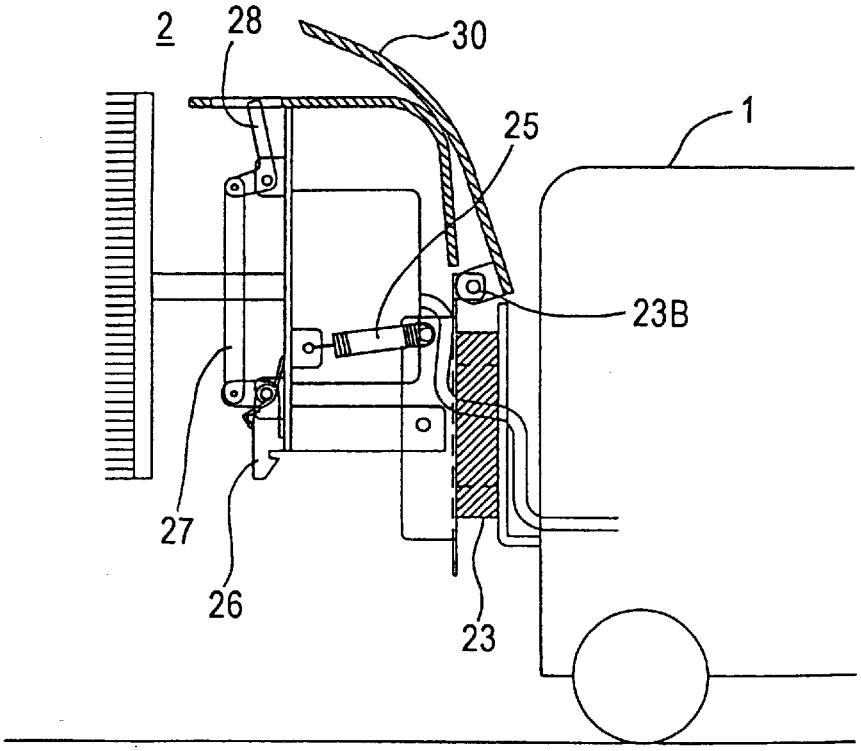

Referring to FIGS. 8 to 13, the operation of working unit 2 coupled by coupling member 23 to body 1 will be described. FIGS. 8 and 9 are cross sections showing the operation of the working unit and the coupling member of the autonomous running and working robot in accordance with the present embodiment. FIGS. 10 to 13 are perspective views showing the operation of the working unit of the autonomous running and working robot in accordance with the present invention.

Referring to FIGS. 5, 8 and 9, when lock canceling lever 28 is pushed up, lock member 26 rotates through coupling arm 27, and locking on coupling member 23 is canceled (FIG. 8). Working unit 2 rotates upward by about 90° about fulcrum 23A by the spring force of spring 25. Namely, it springs upward.

The second cover 30 for covering the notch of the first cover at working unit 2 is also rotated about fulcrum 23B provided at coupling member 23 together with the spring up of working unit 2, and hence it also springs upward.

FIGS. 10 to 13 are perspective views showing the operation of working unit 2. Elements common to those described with reference to FIG. 5 are denoted by the same reference characters and detailed description thereof is not repeated.

Figure 10:
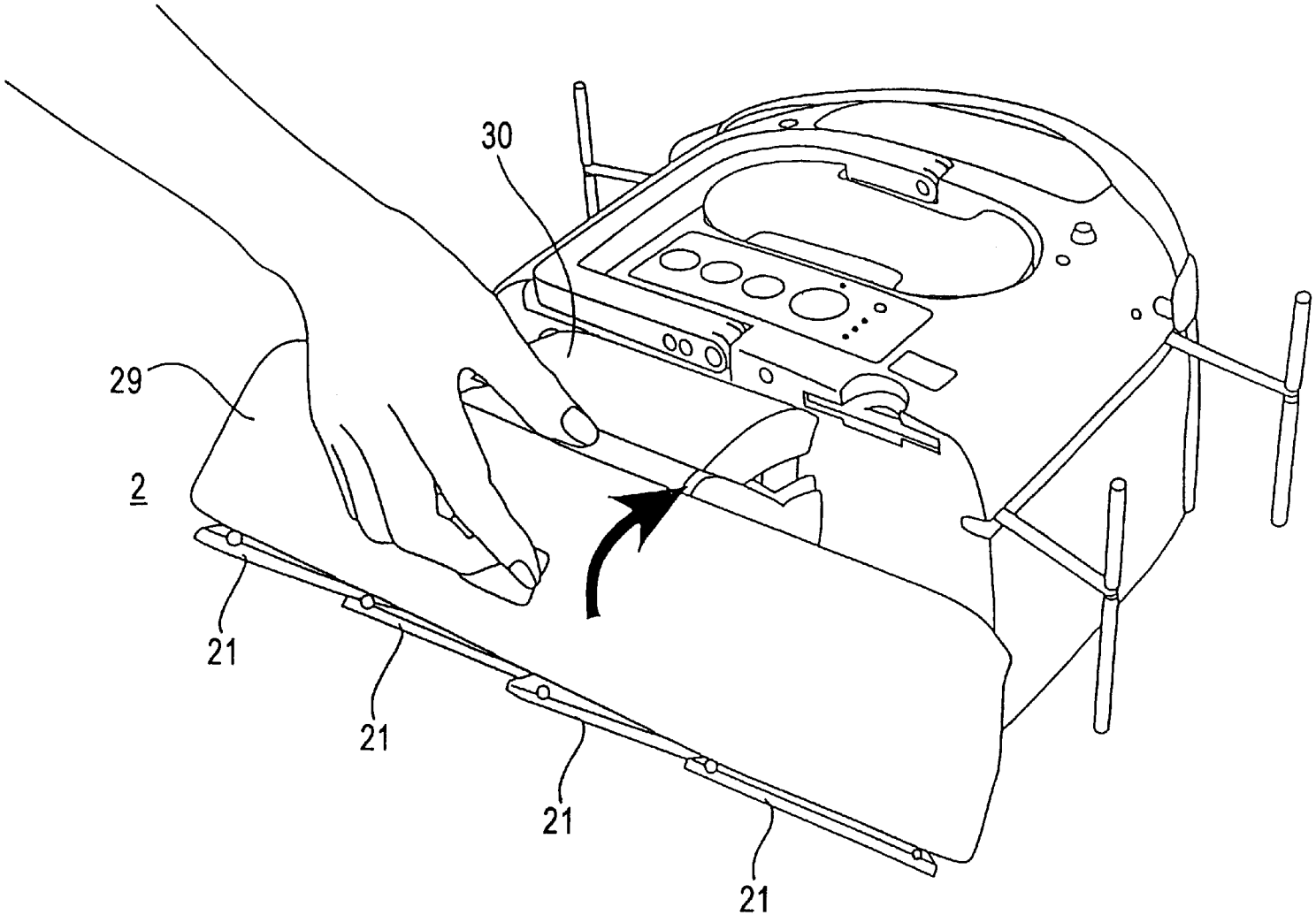
FIGS. 10 to 13 are perspective views showing operations of the working unit of the autonomous running and working robot.

Referring to FIG. 10, when lock canceling lever 28 (FIG. 11) in the first cover 29 is pushed up by an operator, lock member 26 is released, and by the spring force of spring 25, the working unit 2 including rotary brush 21 and the first cover 29 rotates upward. Accordingly, the second cover 30 also rotates upward.

Figure 11:
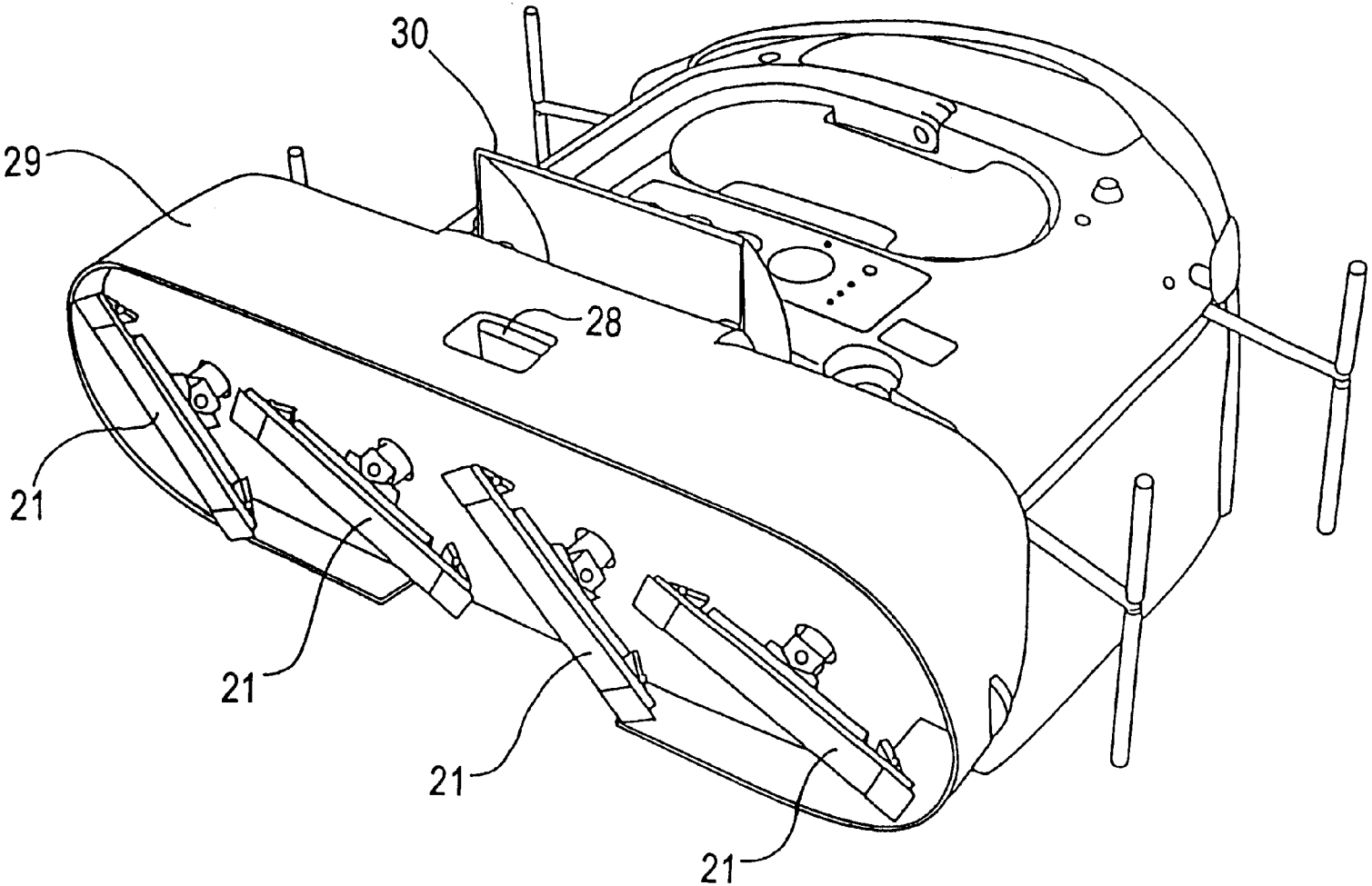

Referring to FIG. 11, as working unit 2 rotates upward, rotary brush 21 attached on the bottom surface of working unit 2 including first cover 29, second cover 30 and lock canceling lever 29 is exposed. Here, a rotary cloth for waxing is used as rotary brush 21.

Figure 12:
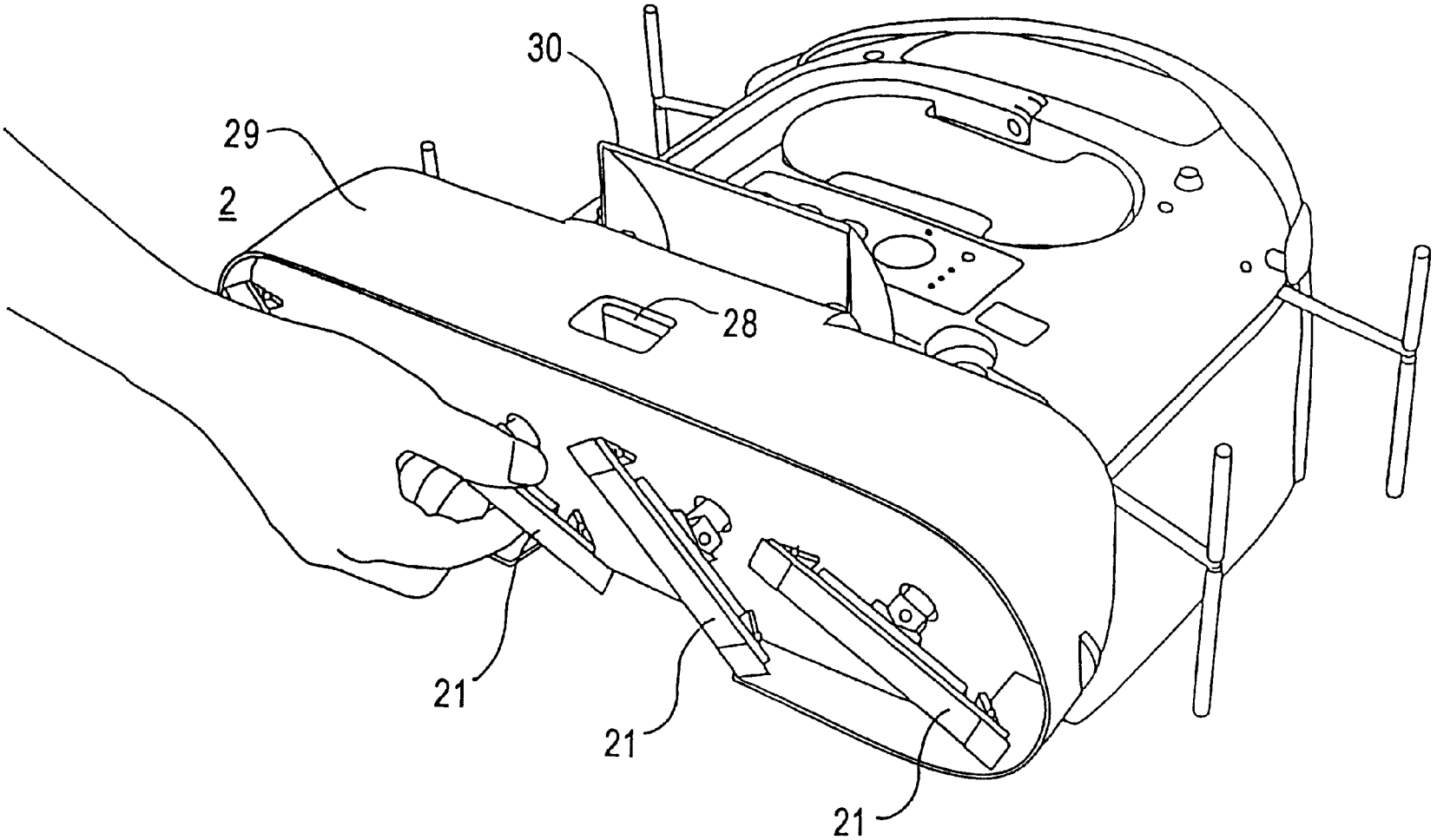

Referring to FIG. 12, rotary brush 21, which is exposed as working unit 2 including first cover 29, second cover 30 and lock canceling lever 28 rotated upward, is exchanged.

Figure 13:
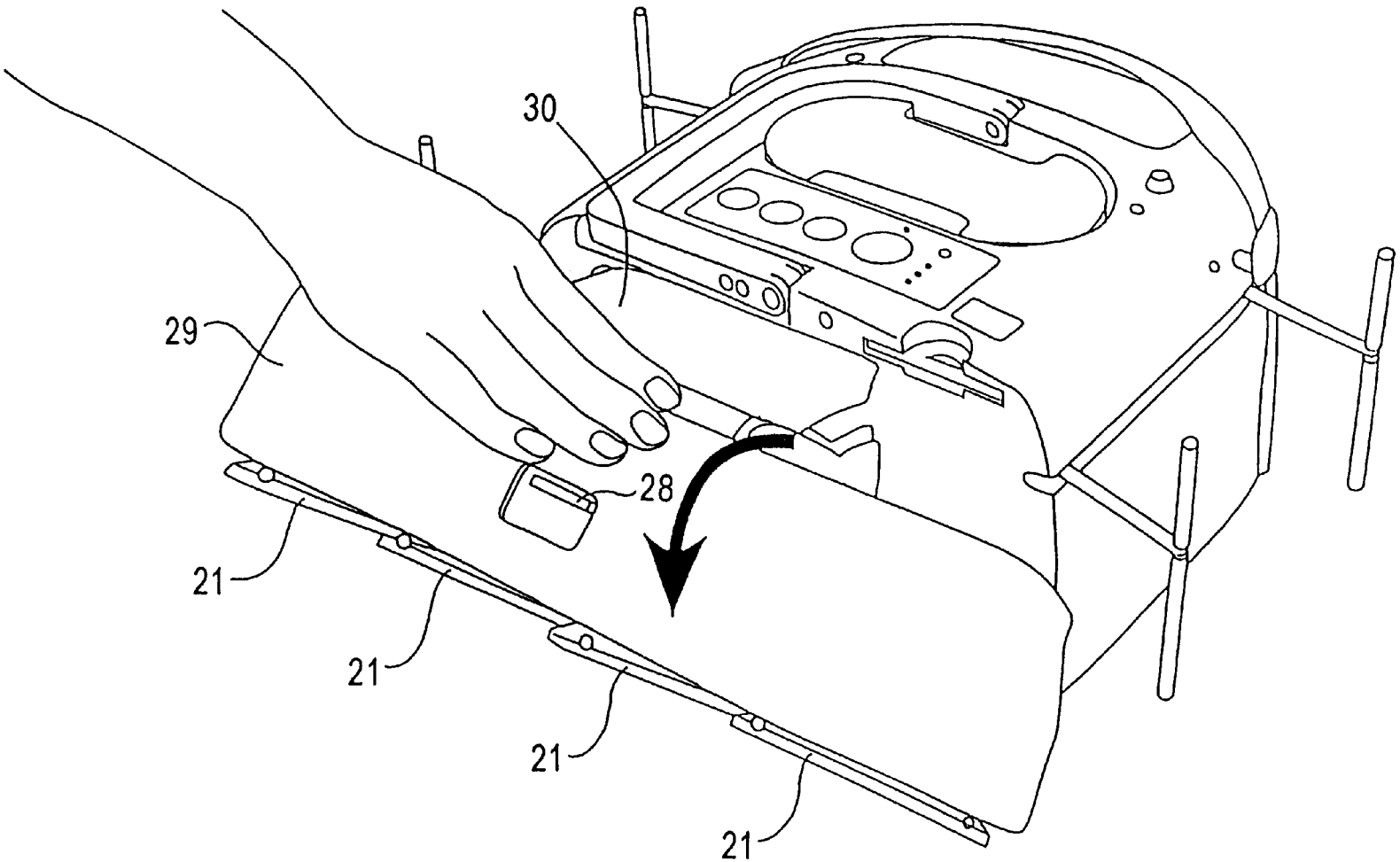

Referring to FIG. 13, after rotary brush 21 is exchanged, working unit 2 including first cover 29 and lock canceling lever 28 is pushed down by the operator. Thus, the second cover 30 also moves downward together with the first cover 29, lock member 26 is locked at coupling member 23, rotary brush 21 comes to be in contact with the bottom surface (FIG. 5) and fixed in a state enabling cleaning.

As described above, in the autonomous running and working robot of the present embodiment, working unit 2 includes spring 25 and lock member 26. Therefore, when rotary brush 21 for cleaning or the rotary cloth for waxing which is attached to working unit 2 and covered by the first cover 29 so that it is not easily viewed from the outside during operation is to be exchanged, the working unit 2 springs upward. Thus, the rear surface (working surface) of working unit 2 is exposed. Therefore, the component such as the rotary brush to be exchanged can be readily viewed and recognized, facilitating exchanging operation.

Further, since working unit 2 springs upward by the spring force, manual force is not necessary to push up the working unit 2. Even when the operator happens to let loose the unit, there is not a possibility of falling and damage to the working unit 2.

Further, the direction (upward direction) for operating lock canceling lever 28 is the same as the direction of spring of the working unit 2 (upward direction), and therefore operator can move his or her hand smooth for activating spring operation.

The first cover 29 has a notch so that it does not abut other member such as coupling member 23 and body 1 at the time of spring up. The notch is covered by the second cover 30 and the second cover 30 also springs upward when the first cover springs upward. Therefore, the first cover 29 can spring upward at a greater angle.

Further, as shown in FIGS. 6 and 7, by forming the buffer member using a resilient body such as rubber, external force and shock in every direction, that is, upward, downward, left, and right directions as well as torsion can be absorbed.

Further, a through hole is provided in the buffer member and pipes and lines such as hose 22, power supply line and signal line between the body and the working unit can be arranged through the through hole, and therefore the lines and pipes can be protected.

Figure 14:
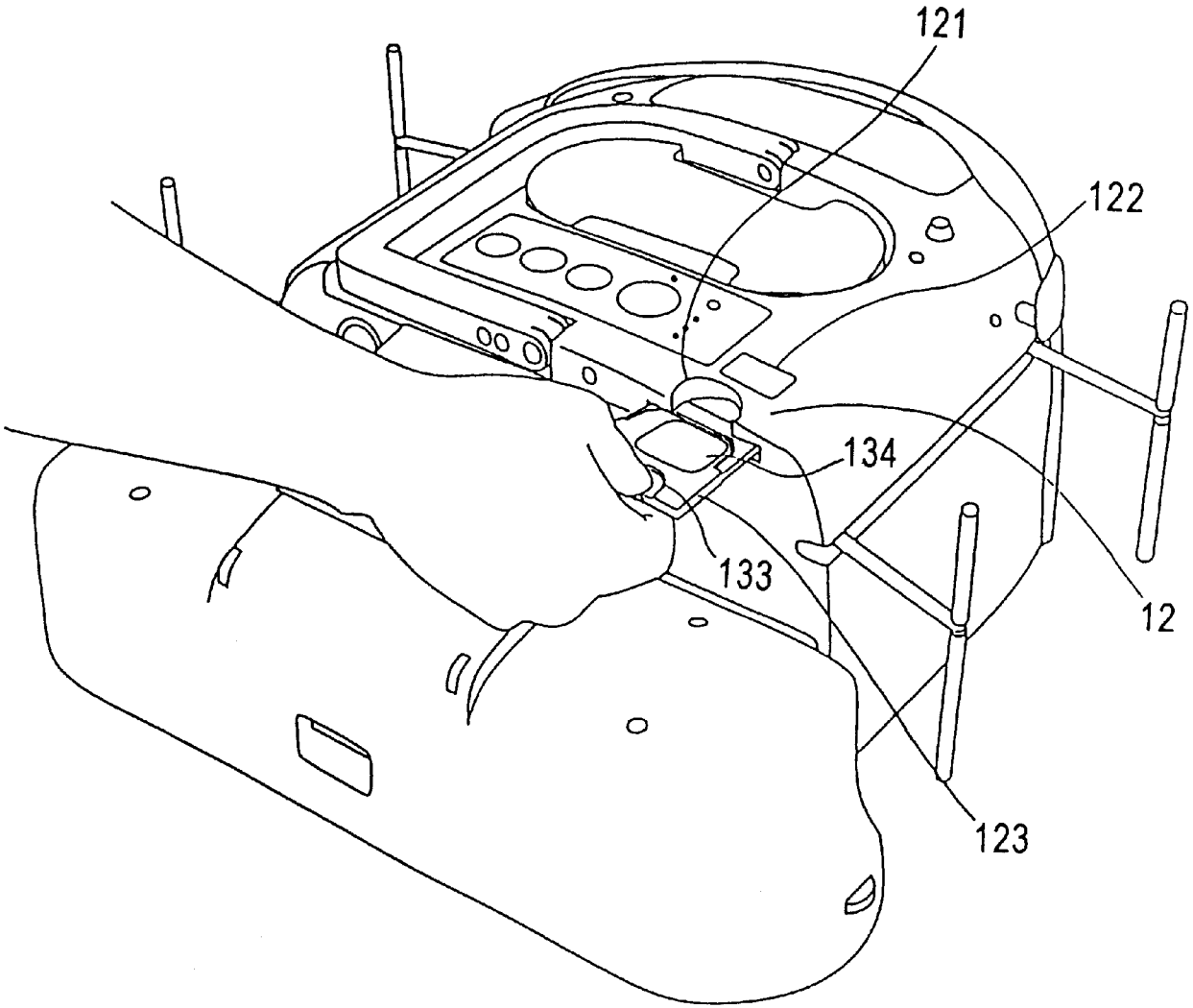
FIG. 14 is a perspective view showing an IC card mounting portion and an IC card for the autonomous running and working robot.

Referring to FIGS. 14 to 18, the IC card mounting portion provided on body 1 and the IC card will be described. FIG. 14 is a perspective view showing the IC card mounting portion and the IC card.

Referring to FIG. 14, an IC card 123 is mounted on IC card mounting portion 12 held by the operator's finger inserted through a through hole 133. At the time of mounting, IC card 123 is fixed at a position where a sticker 134 is placed below a window 122 and the through hole 133 is exposed at a notch 121.

IC card 123 is taken out from IC card mounting portion 12 by the operator inserting his or her finger to the through hole 133 exposed at notch 121 and pulling the card out.

Figure 15:
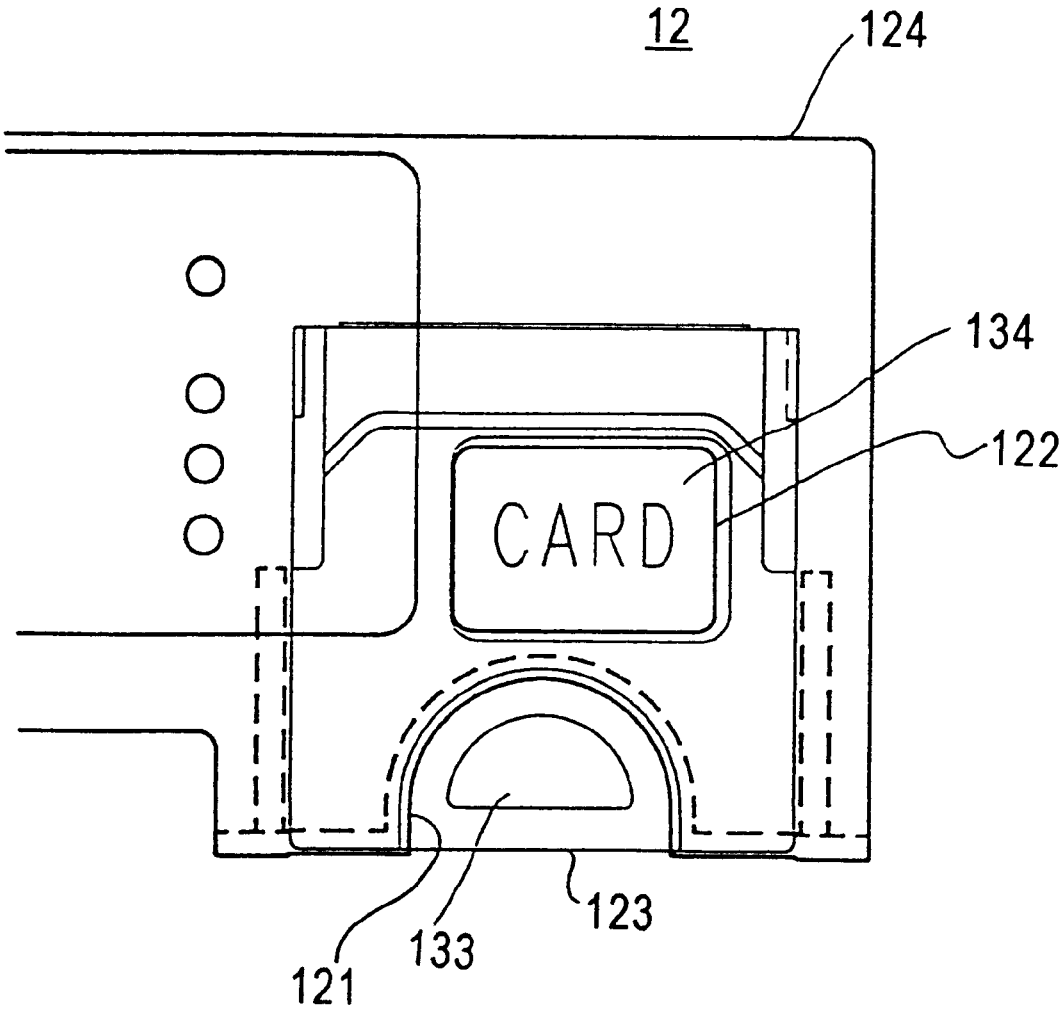
FIG. 15 is a plan view of the IC card mounting portion of the autonomous running and working robot.
Figure 16A:
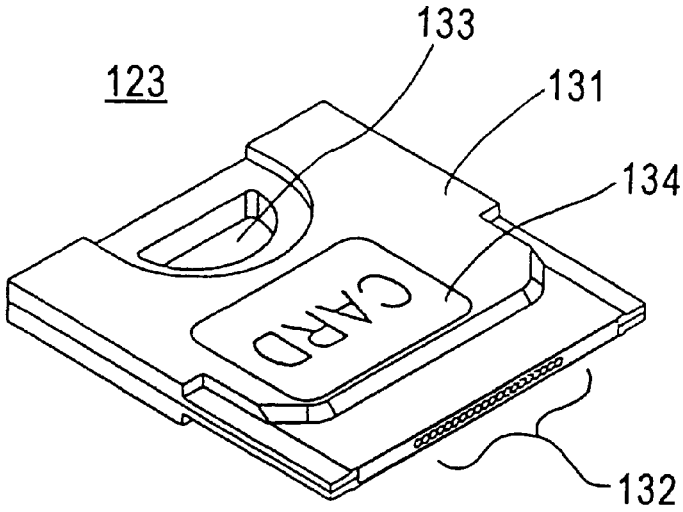
FIG. 16A is a perspective view of the IC card used for the autonomous running and working robot and FIG. 16B is a plan view thereof.
Figure 16B:
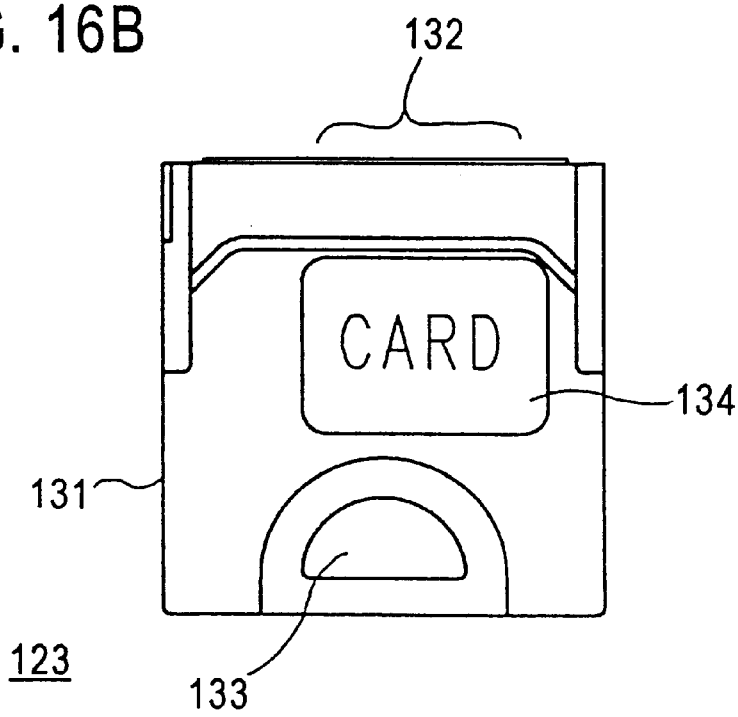

Referring to FIGS. 15 to 18B, the IC card mounting portion 12 shown in FIGS. 1 and 14 will be described in more detail. FIG. 15 is a plan view of the IC card mounting portion. FIG. 15 shows the IC card mounting portion 12 with IC card 123 mounted. FIG. 16A is a perspective view and FIG. 16B is a plan view of the IC card.

Referring to FIGS. 15 to 17, IC card 123 includes an electronic circuit, not shown, a card-shaped case 131 for protecting the electronic circuit, a connector 132 for detachably connecting the electronic circuit to the outside provided at one end of case 131, and a sticker 134 for writing comments related to the IC card, for example, thereon.

IC card mounting portion 12 includes a member 124 having a notch 121 at a position where through hole 133 of IC card 123 is exposed when IC card 123 is mounted. Member 124 has a window 122 at a position where sticker 134 of IC card 123 is exposed when IC card 123 is mounted.

The case 131 of IC card 123 has through hole 133 through which the operator's finger is inserted, at an end portion opposite to that end which is provided with connector 132.

Figure 17A:
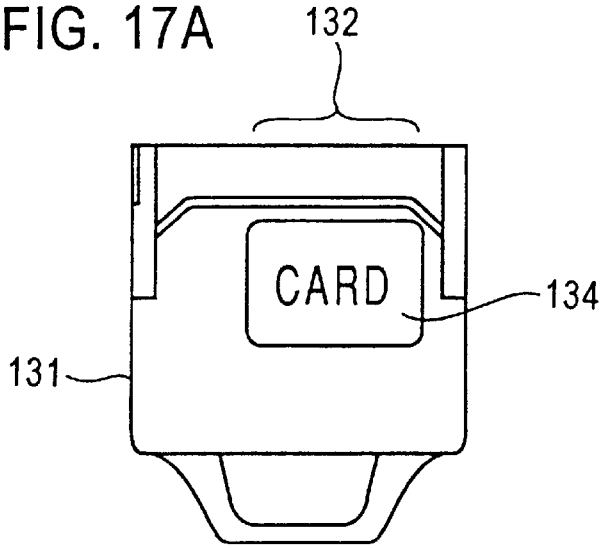
FIGS. 17A and 17B are plan views showing another example of the IC card used for the autonomous running and working robot.
Figure 17B:
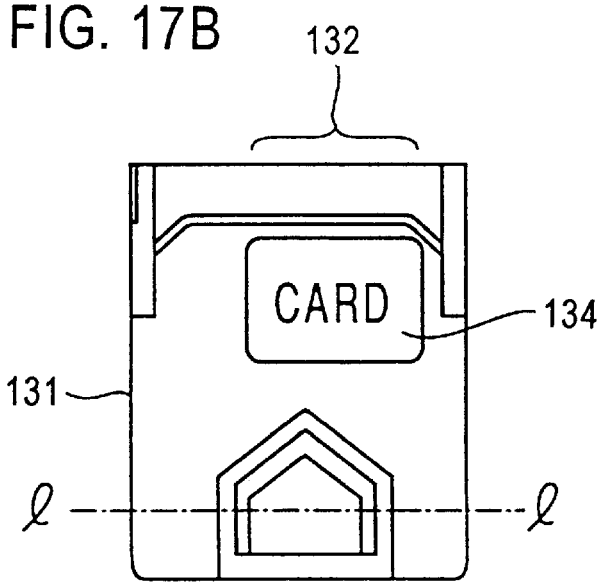
Figure 17C:
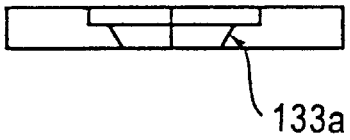
FIG. 17C is a cross section of a portion taken along the line L—L of FIG. 17B.

FIGS. 17A and 17B are plan views showing another example of IC card 123 and FIG. 17C is a cross section of FIG. 17B taken along the line l—l'. Referring to FIGS. 17B and 17C, the front and rear sides of IC card 123 can be readily distinguished by a step and a tapered surface 133*a*, and the hole indicates the direction of insertion.

Figure 18A:
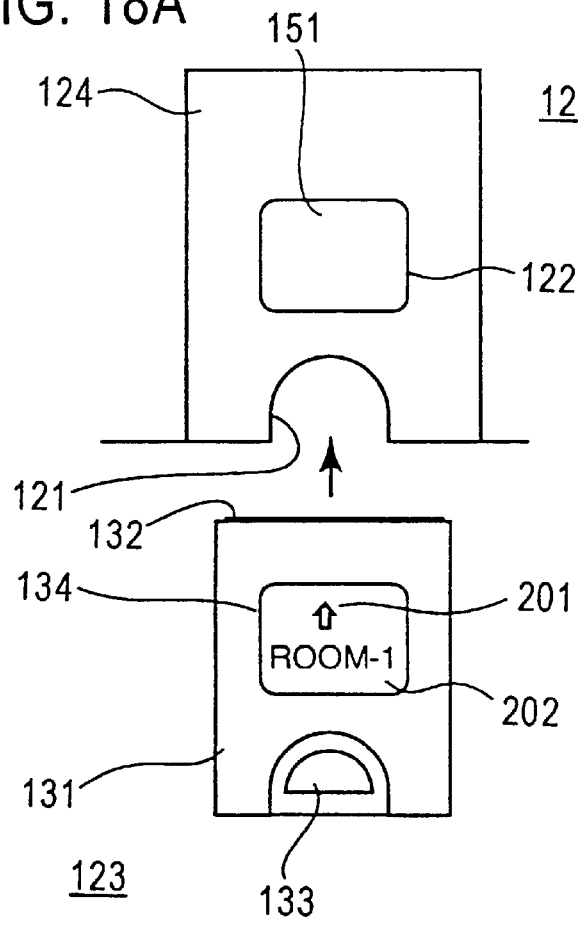
FIGS. 18A and 18B are plan views showing main portions of a first example of a window at the IC card mounting portion of the autonomous running and working robot.
Figure 18B:
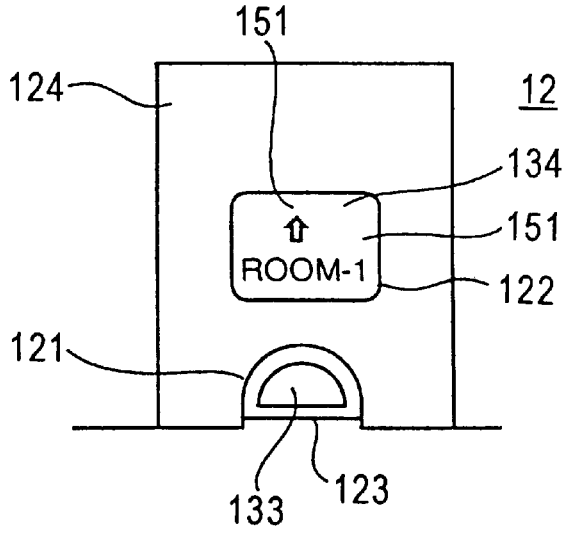

Referring to FIGS. 18A and 18B, window 122 of IC card mounting portion 12 shown in FIG. 15 will be described. FIGS. 18A and 18B are plan views showing a main portion of the first example of the window at the IC card mounting portion. FIG. 18A is a plan view of the main portion before mounting the IC card and FIG. 18B is a plan view of the main portion after mounting the IC card. Portions corresponding to those described with reference to FIGS. 15 to 17 are denoted by the same reference characters and detailed description thereof is not repeated.

Referring to FIGS. 18A and 1BB, window 122 of IC card mounting portion 12 includes a transparent cover 151 fixed on member 124.

A mark 201 for preventing reverse insertion is provided on sticker 134 of IC card 123, and writing by a pencil, pen or the like is possible on the remaining comment portion 202 of the sticker. With reference to FIG. 18A, "ROOM-1" is written as an example of a comment. The content written on the sticker will be positioned below window 22 when IC card 133 is mounted.

As described above, according to the IC card mounting portion of the autonomous running and working robot of the present embodiment, when an IC card for storing data instructing operation procedure of the autonomous running and operating robot is to be used, an ejecting mechanism such as a lever is not necessary, and the IC card can be easily taken out by simply inserting one's finger through the through hole of the IC card and pulling out the card, and hence the size of the autonomous running and operating robot can be made smaller.

Further, it is possible to securely hold and take out the IC card without slipping even when the operator wears gloves, for example, when the robot is used in a clean room of a hospital. Further, the IC card can be hung on a hook on the wall using the through hole. This facilitates storage of IC card. This is more effective when IC cards having different contents for different rooms are prepared in order to optimize cleaning of respective rooms, as the cards can be hung on the wall of respective rooms.

Further, since the window is provided at the IC card mounting portion, the type of IC card can be identified after the IC card is mounted, and correct working area and working data corresponding to the operation of the robot can be provided.

Further, a mark showing the direction of insertion is provided at a prescribed portion of the IC card, allowing writing by a pencil, a pen or the like on the remaining part, erroneous insertion of the IC card can be prevented, and the card on which comments or the like is freely written by the user can be confirmed even after the IC card is mounted.

When the window is formed or covered by a transparent member, it provides dust proof and water proof. Meanwhile, if the window is open, it is possible to write on the IC card by a pen or the like even after the IC card is mounted.

Figure 19:
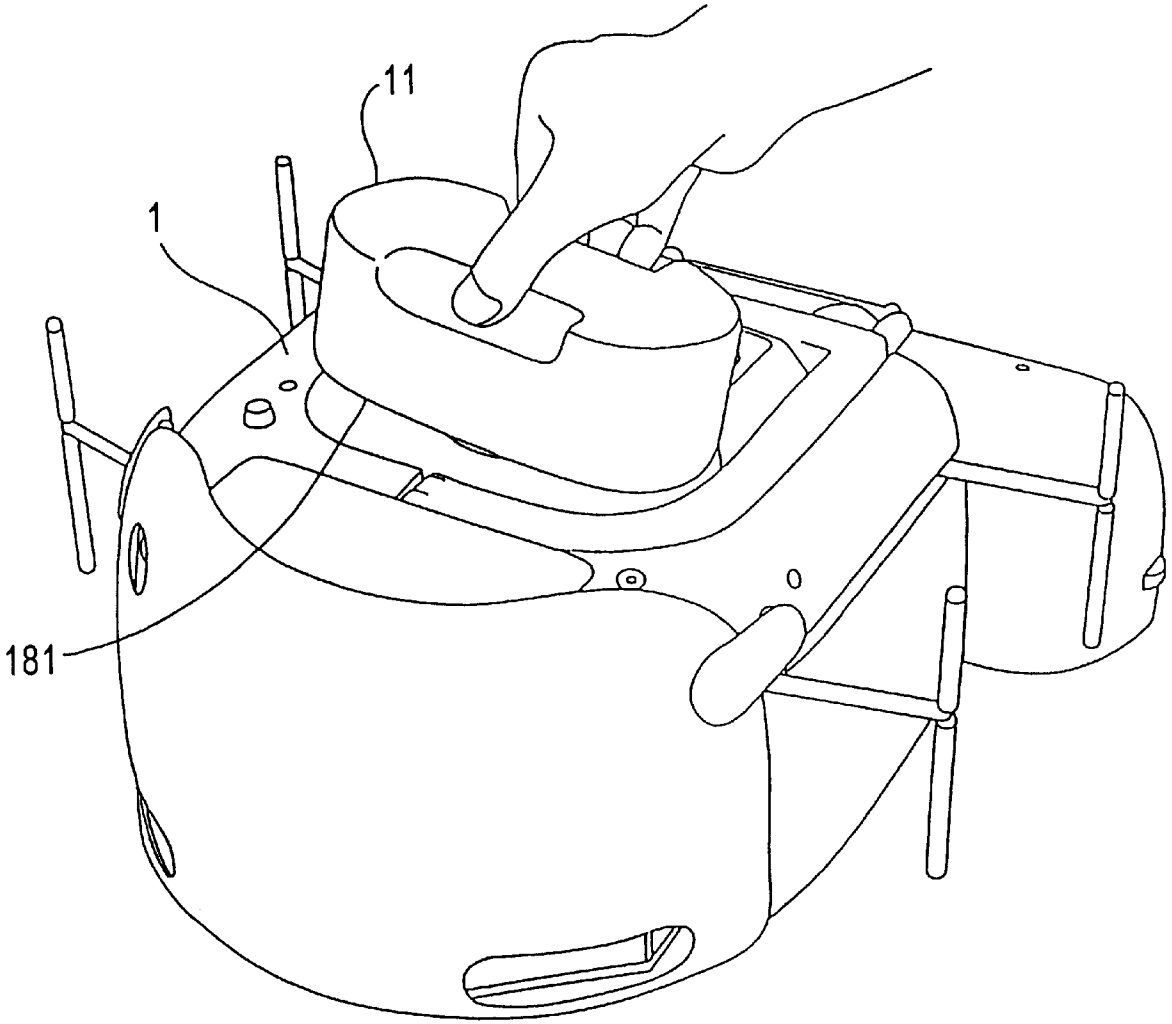
FIG. 19 is a perspective view showing how a tank is mounted on the autonomous running and working robot.
Figure 20:
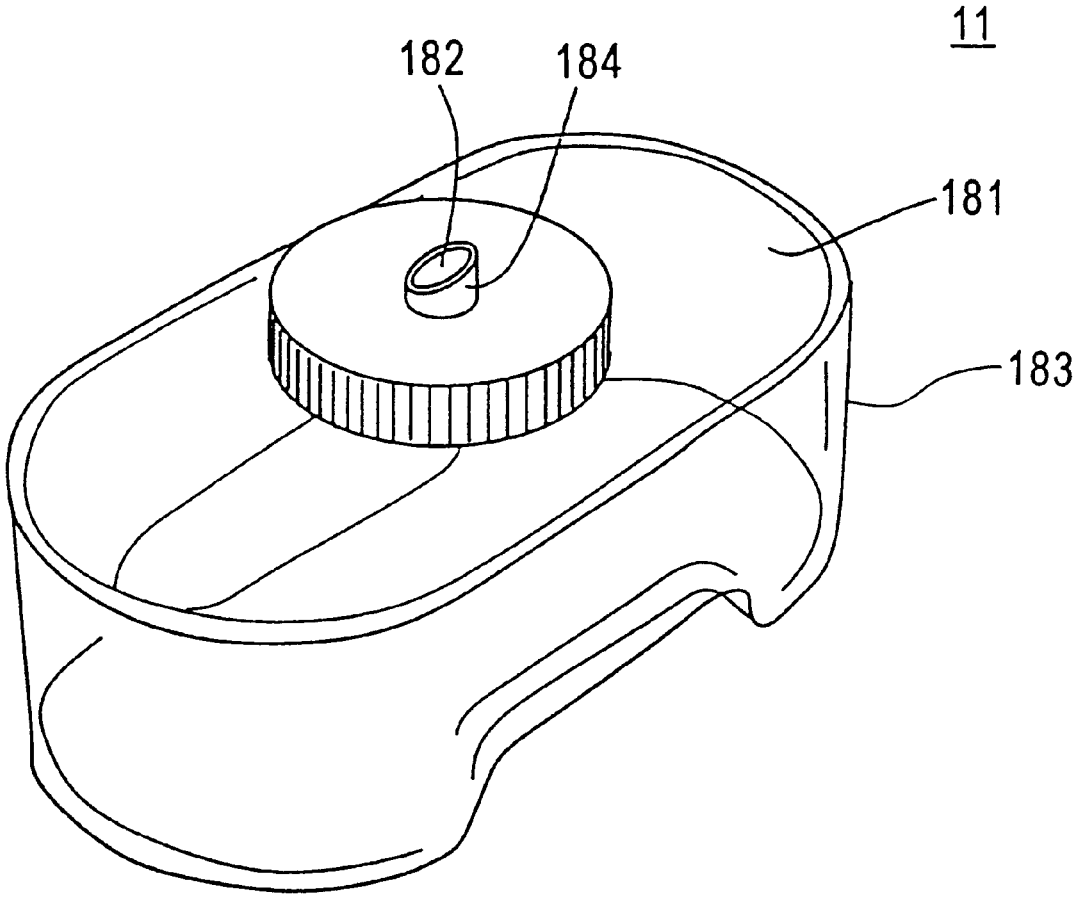
FIG. 20 is a perspective view of the tank of the autonomous running and working robot.
Figure 21:
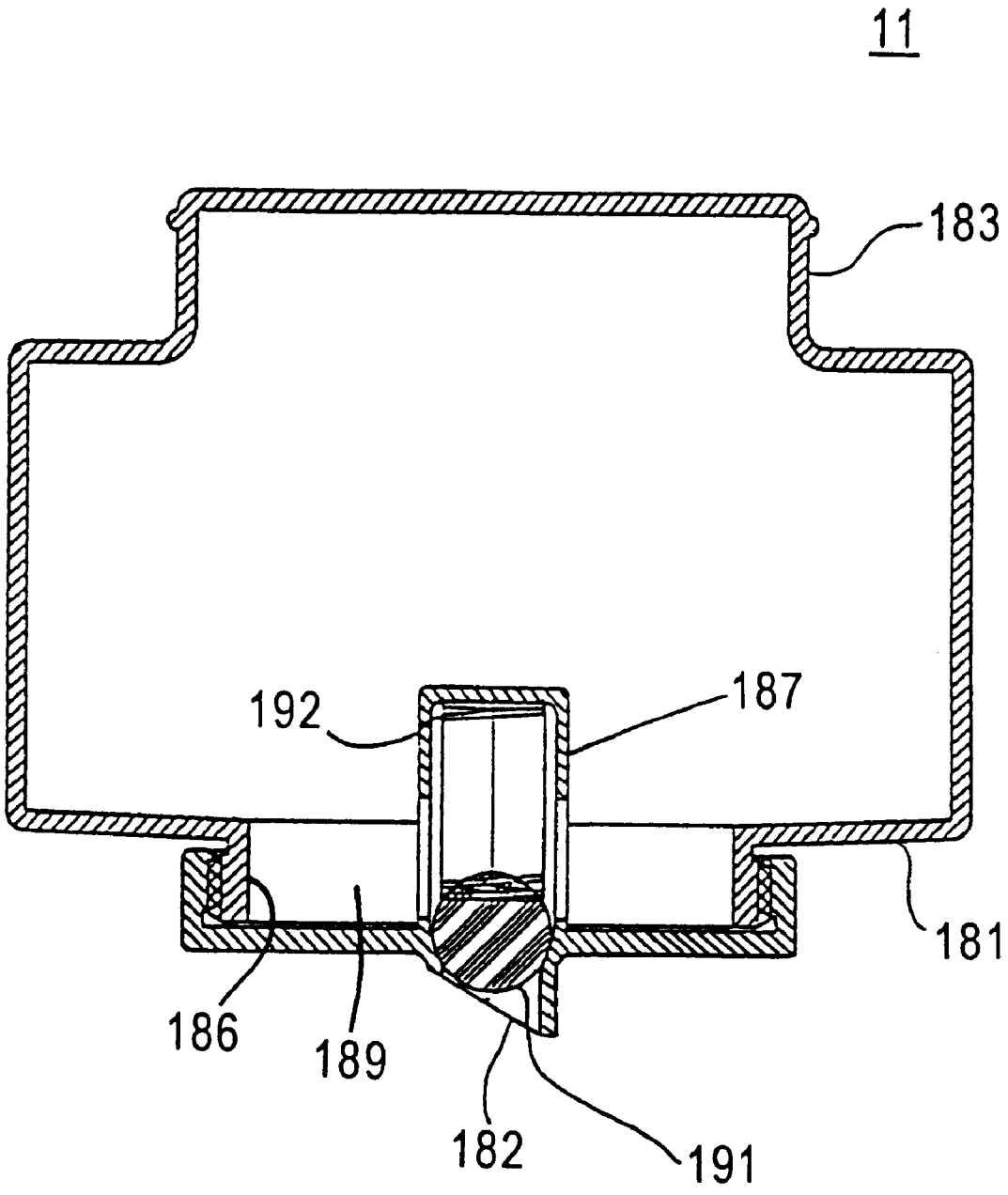
FIG. 21 is a cross section of the tank of the autonomous running and working robot.
Figure 22:
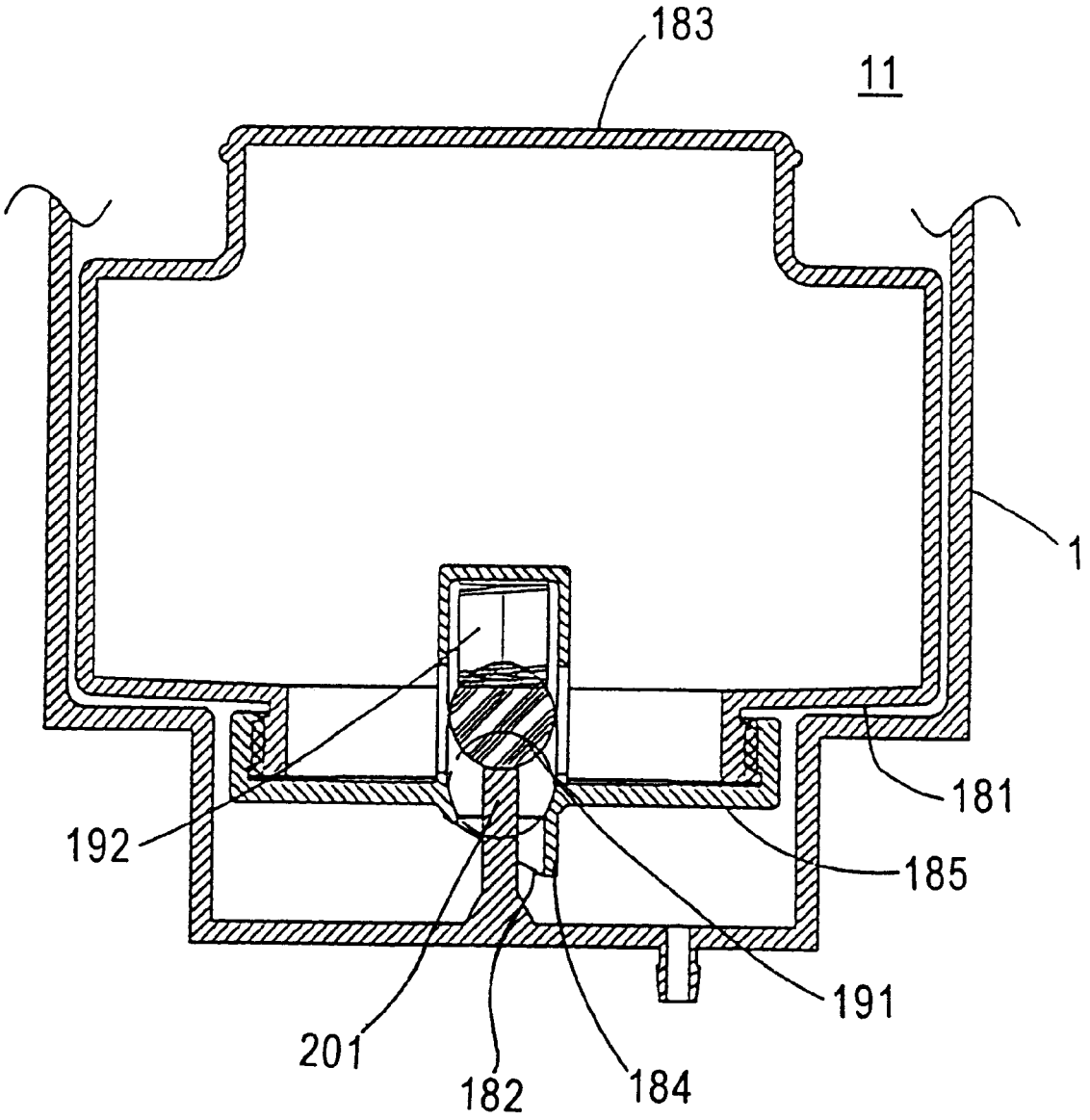
FIG. 22 is a cross section of the autonomous running and working robot when the tank is mounted.

Referring to FIGS. 19 to 23B, tank 11 shown in FIG. 1 will be described. FIG. 19 is a perspective view showing how the tank is attached. FIG. 20 is a perspective view of the tank, FIG. 21 is a cross section of the tank and FIG. 22 is a cross section when the tank is mounted.

Referring to FIGS. 19, 20 and 21, tank 11 includes a tank portion or liquid reservoir or holding 183 for containing liquid with an opening 189 formed by a neck 186 protruding from a flat surface or bottom plare position 181 which will be the bottom of the tank portion 183 when the tank is in use; a liquid dispensing member including a lid 185 and 184 having a cylindrically shape sleeve 187 in a centrally located portion of the lid 185 at a right angle with respect to the flat surface 181, with an opening 182 formed in the tip end 184 of the sleeve 187 being cut diagonally with respect to the central axis of the sleeve 187, and with the lid 185 being detachably fixed to the neck 186 of the tank portion 183; a ball valve 191 for suppressing leakage of the liquid contained in the tank portion 183; and a spring 192 for urging the ball valve 191 toward the opening 182.

Body 1 includes a valve push up, projecting or shaft pin 201 for pushing up ball valve 191. Ball valve 191 has the diameter of about 12 mm, and valve push up pin 201 has the diameter of about 4 mm.

The operation of tank 11 provided on body 1 will be described. Referring to FIGS. 19, 20 and 22, tank 11 is mounted on body 1 such that the flat surface 181 forms the bottom surface and the valve push up pin 201 is received at opening 182. The ball valve 191 which has been closed by the urging of spring 192 is pushed up by valve push up pin 201, and hence it opens. When the tip end portion of liquid dispensing member 184 is cut vertical to the central axis of the cylinder, the liquid in the tank does not drop out from the tank because of surface tension of the liquid, in accordance with the limit of opening area of the cylinder and the surface tension. However, when the tip end portion is cut diagonally, balance of the surface tension is lost, and the liquid drops out of the tank because of gravity.

Figure 23A:
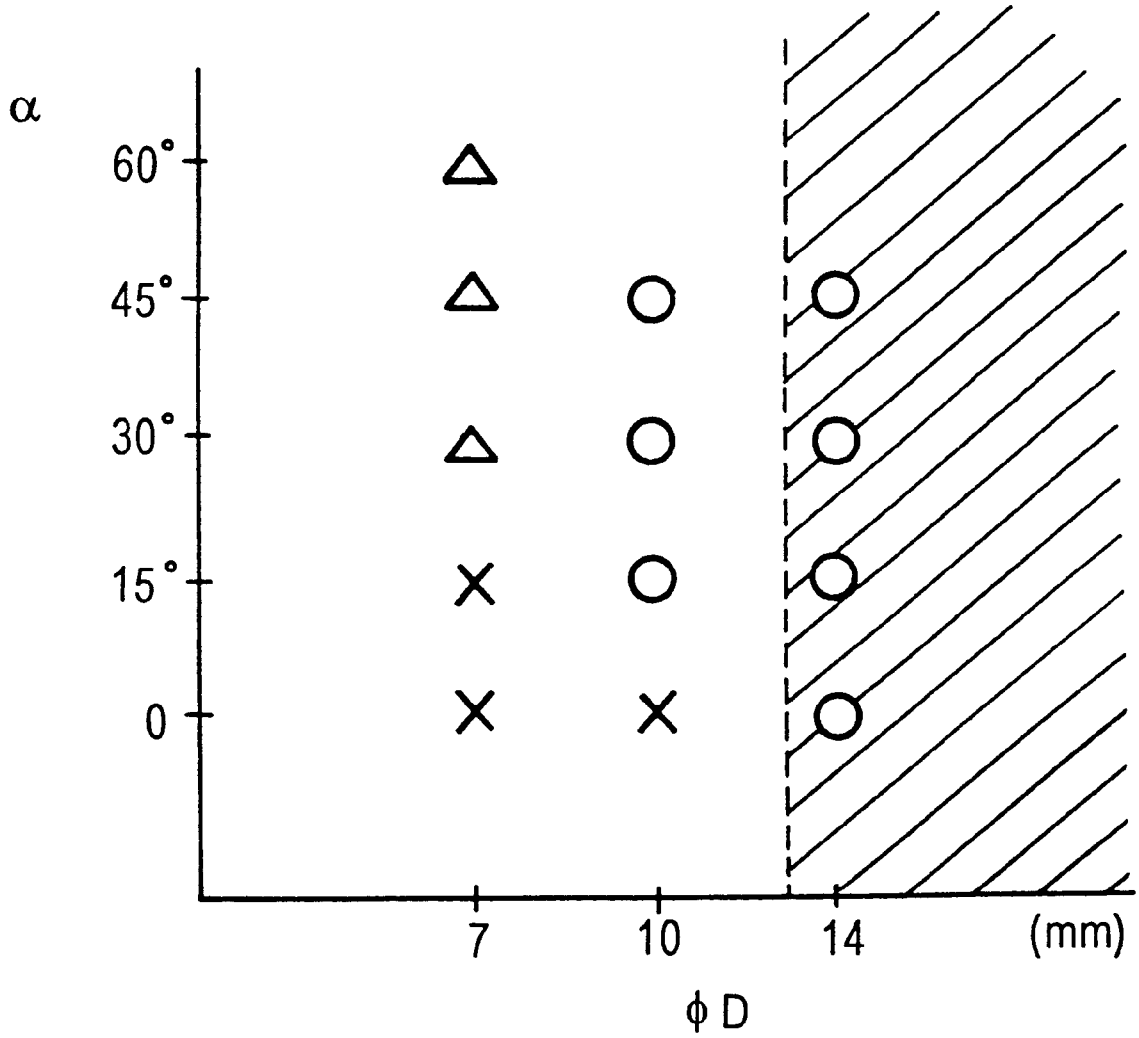
FIGS. 23A and 23B are graph showing results of experiment related to the shape of liquid dispensing member at the tank of the autonomous running and working robot.
Figure 23B:
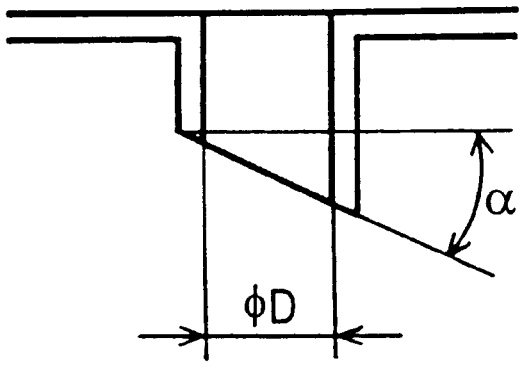

FIGS. 23A and 23B is a graph showing the result of experiment related to the shape of the liquid dispensing member of the tank.

Referring to FIGS. 23A and 23B, when the diameter $\phi D$ of the cylinder is 10 mm, the cutting angle $\alpha$ at the tip end-portion of liquid dispensing member 184 should be at least 15° with respect to the orthogonal direction of the central axis of the cylinder. When the diameter $\phi D$ is 7 mm, the effect is not provided even when the tip end is cut diagonally. When the diameter $\phi D$ of the cylinder is 14 mm, liquid flows out of the tank regardless of the cutting angle. However, liquid leaks because of insufficient sealing. When spring force of spring 192 is made higher for improved sealing, there would be a side effect such as lifting of the tank 11 itself, and therefore it is not practical.

The liquid used for the experiment was water at the temperature of 15° C. The surface tension thereof is 73.48 (dyn/cm) according to RIKANENPYO (ISBN 4-621-04266-1).

As described above, according to the tank of the present embodiment, as the tip end portion of the liquid dispensing member is cut diagonally, even a liquid having high surface tension can be dropped out from the tank through the liquid dispensing member.

Further, a valve is provided in the liquid dispensing member which is adapted to open when it is placed on the tank receiving portion of the body and closes when the tank is taken out, so that the liquid is not leaked when the tank is removed.

Further, the cylinder of the liquid dispensing member is provided on a cap 185 which is fitted in the opening at the bottom surface of the tank. Therefore, it is not necessary to separately provide an opening for putting the liquid into the tank. Furthermore, since there is only one opening, the upper surface of the tank can be made flat and when the liquid is put into the tank, the tank can be placed upside down with the upper surface facing downward. Therefore, the tank can be placed stably.

Further, the spring force of the spring urging the valve is set to be little smaller than the weight of the tank. Therefore, even when the liquid in the tank is reduced or used up, the tank will not be lift up by the spring force.

The spring force is calculated in the following manner. When we represent the weight of the tank by T (180 g) and spring force when the tank is mounted on the robot by F, the following relation must be satisfied to prevent lifting of the tank:

$$T>F$$

When we represent spring constant by k and amount of compression of the spring by L, then $$F=kL$$

Therefore, the spring constant k and the amount of compression L must be set to satisfy T>kL. In the present embodiment, the values are set to k=4.6 gf/mm and L=32 mm. Namely, 180>4.6×3.2=147.2, thus the relation T>kL is satisfied.

Figure 24A:
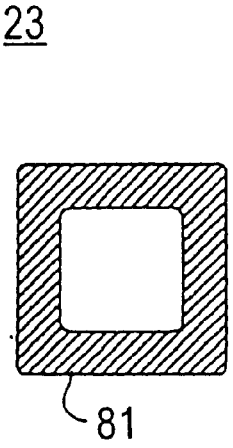
FIGS. 24A and 24B show a second example of the structure of the coupling unit for the autonomous running and working robot.
Figure 24B:
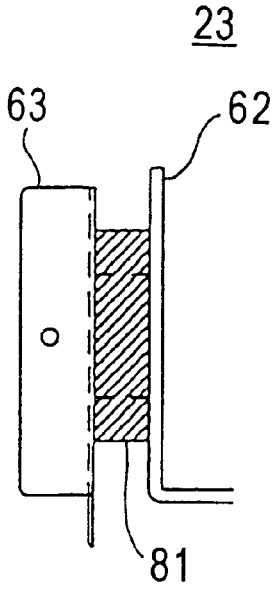

FIGS. 24A and 24B show the second example of the structure of the coupling member described above. Referring to FIGS. 24A and 24B, coupling member 23 includes a buffer member 81 and support members 62 and 63. Buffer member 81 has a hollow rectangular shape. Support members 62 and 63 have holes of approximately the same size at a position corresponding to the hollow hole of buffer member 81. Therefore, coupling member 23 comes to have a through hole at this portion.

Since buffer member 81 has a rectangular shape, shock in the upward, downward, left and right directions can be absorbed uniformly. However, shock in the diagonal direction is not much absorbed. However, the shape of the buffer member 81 may be determined in accordance with the direction of the shock to be absorbed.

Figure 25A:
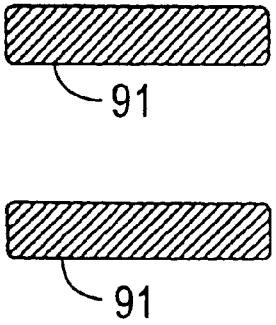
FIGS. 25A and 25B show a third example of the structure of the coupling member of the autonomous running and working robot.
Figure 25B:
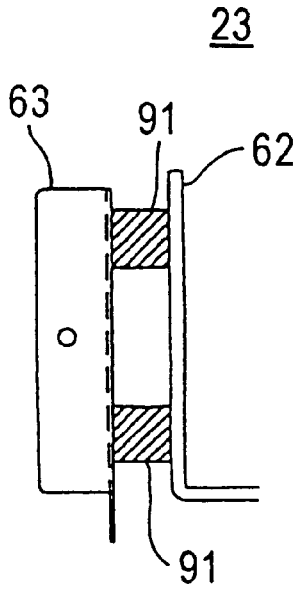

FIGS. 25A and 25B shows the third example of the structure of the coupling member. Referring to FIGS. 25A and 25B, buffer member 23 includes two rectangular buffer members 91 and support members 62 and 63.

Figure 26A:
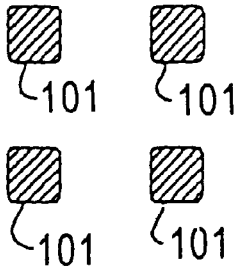
FIGS. 26A and 26B show a fourth example of the structure of the coupling unit for the autonomous running and working robot.
Figure 26B:
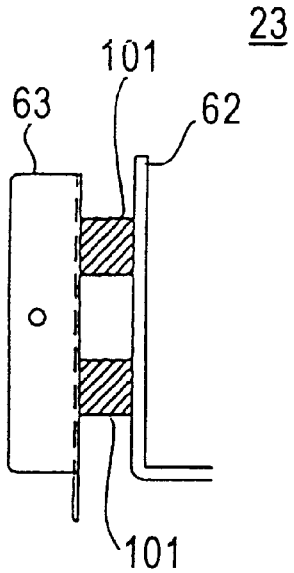

FIGS. 26A and 26 show the fourth example of the structure of the coupling member. Referring to FIGS. 26A and 26B, buffer member 23 includes four rectangular buffer members 101 and support members 62 and 63.

Buffer member including a number of buffer members such as shown in FIGS. 25 and 26 are also helpful in a absorbing shock.

Figure 27:
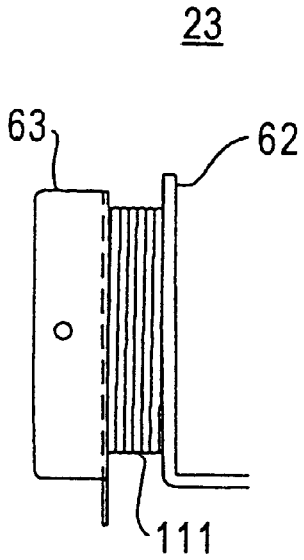
FIG. 27 shows a fifth example of the structure of the coupling unit for the autonomous running and working robot.

FIG. 27 shows the fifth example of the structure of the coupling member. Referring to FIG. 27, coupling member 23 includes a spring 111 and support members 62 and 63.

The buffer members shown in FIGS. 6, 7 and 24A to 27B must have flexibility, absorb shock, have sufficient strength to hold working unit 2 and must be less susceptible to aging. Rubber, plastic (for example, urethane or engineering plastics) may be used as the material for the buffer members shown in FIGS. 6, 7 and 24A to 26B. In the present embodiment, chloroprene (Neoprene) having compression spring constant of 450 kgf/mm, shear spring constant of 90 kgf/mm, rubber hardness (JISA) of about 42 is used.

Figure 28:
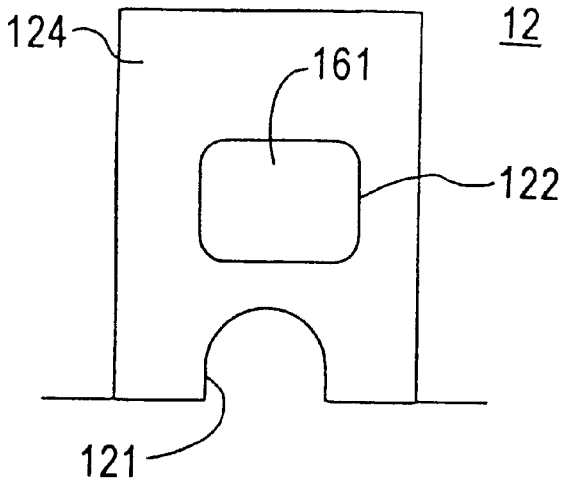
FIG. 28 is a plan view of a main portion showing a second example of the window at the IC card mounting portion of the autonomous running and working robot.

FIG. 28 is a plan view of a main portion showing a second example of the window at the IC card mounting portion described above.

Figure 29:
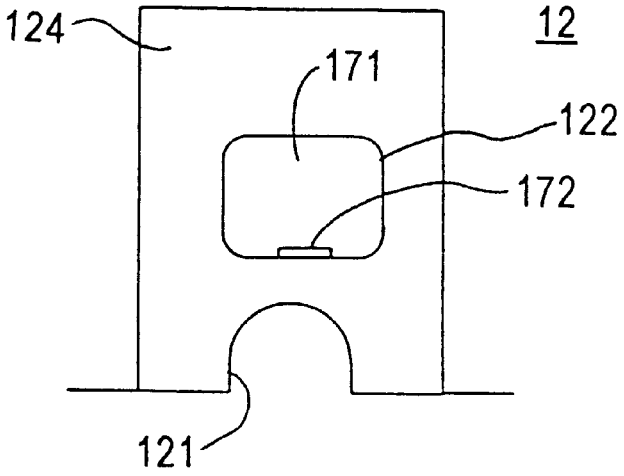
FIG. 29 is a plan view showing a main portion of a third example of the window at the IC card mounting portion of the autonomous running and working robot.

FIG. 29 is a plan view of a main portion showing a third example of the window at the IC card mounting portion. Referring to FIG. 28, window 122 of IC cassette mounting portion has an opening 161.

Referring to FIG. 29, window 122 of IC cassette mounting portion 12 includes a transparent opening/closing lid 171 attached to be opened/closed on member 104, and an opening/closing knob 172 for opening or closing the transparent lid 171.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A tank for dispensing an amount of liquid contained therein, comprising:

a liquid reservoir for holding liquid, said liquid reservoir having a surface with an opening in said surface, and said surface serving as a bottom portion when said liquid reservoir is in use;

a sleeve formed in a portion of said liquid reservoir, said sleeve protruding from said liquid reservoir in a direction vertical to said surface, said sleeve having a tip end cut diagonally with respect to a central axis, and said sleeve being open at said tip end;

an opening/closing valve, at the upstream side of the diagonally cut tip end portion of the liquid dispensing portion, for controlling dispensing of fluid from said liquid reservoir; and a spring for urging the valve to a closed position.

2. The tank according to claim 1, wherein the opening in said sleeve is the only opening in said tank for permitting liquid to exit from said tank via said opening/closing valve.

3. The tank according to claim 1, wherein said opening/closing valve is a ball valve, and wherein said sleeve has circular cross section.

4. The tank according to claim 1, wherein said surface is a flat plate.

5. A tank for dispensing an amount of liquid contained therein, said tank comprising:

a liquid reservoir for holding liquid, said liquid reservoir having a surface with an opening in said surface, and said surface serving as a bottom portion when said liquid reservoir is in use;

a sleeve formed in a portion of said surface, said sleeve protruding from said surface in a direction vertical to said surface, said sleeve having a tip end cut diagonally with respect to a central axis, and said sleeve being open at said tip end;

an opening/closing valve for controlling dispensing of fluid from said liquid reservoir; and a spring for urging the valve to a closed position, wherein said tank is opened against urging of said spring when set in a dedicated apparatus, by means of a projecting pin provided on the apparatus.

6. The tank according to claim 5, wherein said apparatus is a cleaning vehicle for cleaning a floor surface, and said tank contains cleaning liquid.

7. A liquid dispensing structure for dispensing an amount of liquid held in a liquid reservoir, said liquid dispensing structure comprising:

a sleeve protruding from a bottom surface of said liquid reservoir in a direction vertical to said bottom surface, said sleeve having a tip end portion cut diagonally with respect to a central axis, said sleeve open at said tip end portion;

a valve, at an upstream side of the tip end portion of said sleeve, for controlling dispensing of fluid from said liquid reservoir; and a spring for urging the valve towards the tip end portion to a closed position.

* * * * *